US006526787B2

(12) United States Patent
Ming-Chih

(10) Patent No.: US 6,526,787 B2
(45) Date of Patent: Mar. 4, 2003

(54) DOOR LOCK DEVICE PROVIDED WITH MEANS TO DRIVE COAXIALLY LOCK BOLT AND LOCK TONGUE

(75) Inventor: Chen Ming-Chih, Taichung (TW)

(73) Assignee: Summit Automation Co. Ltd., Taichung (TW)

( * ) Notice: Subject to any disclaimer, the term of this patent is extended or adjusted under 35 U.S.C. 154(b) by 3 days.

(21) Appl. No.: 09/832,223

(22) Filed: Apr. 9, 2001

(65) Prior Publication Data

US 2002/0166352 A1 Nov. 14, 2002

(51) Int. Cl.[7] ..... E05B 59/00; E05B 63/14; E05B 47/00

(52) U.S. Cl. ..... 70/107; 70/110; 70/279.1; 70/278.7; 70/283

(58) Field of Search ..... 70/107, 108, 109, 70/110, 111, 279.1, 278.7, 283

(56) References Cited

U.S. PATENT DOCUMENTS 3,672,714 A * 6/1972 Schultz ..... 292/144
4,838,053 A * 6/1989 Shen ..... 292/336.3
5,027,625 A * 7/1991 Krachten ..... 292/165
5,421,178 A * 6/1995 Hamel et al. ..... 292/139
5,495,731 A * 3/1996 Riznik ..... 70/107
5,657,653 A * 8/1997 Hensley et al. ..... 70/224
5,857,365 A * 1/1999 Armstrong ..... 292/39
6,131,966 A * 10/2000 Hensley et al. ..... 70/149
6,223,567 B1 * 5/2001 Fadul ..... 70/224
6,374,653 B1 * 4/2002 Gokcebay et al. ... 292/DIG. 62

FOREIGN PATENT DOCUMENTS

GB 2122244 A * 1/1984

* cited by examiner

*Primary Examiner*—Anthony Knight
*Assistant Examiner*—Michael J. Kyle
(74) *Attorney, Agent, or Firm*—W. Wayne Liauh

(57) ABSTRACT

A door lock device comprised a main body, a lock bolt, a lock tongue, a spindle, and two moving collars. The spindle is connected with the lock bolt by a lock bolt transmission mechanism. The spindle is connected at one end with a lock control mechanism located in the external side of the main body. The spindle is provided at both ends with a moving collar having a retaining portion which is connected with the lock tongue by a lock tongue transmission mechanism. A rotating mechanism is disposed in the external side of the main body such that the rotating mechanism is coaxial with the lock control mechanism. The lock bolt and the lock tongue are coaxially driven.

6 Claims, 9 Drawing Sheets

DOOR LOCK DEVICE PROVIDED WITH MEANS TO DRIVE COAXIALLY LOCK BOLT AND LOCK TONGUE

FIELD OF THE INVENTION

The present invention relates generally to a door lock device, and more particularly to a door lock device which is provided with means to drive a lock bolt and a lock tongue coaxially.

BACKGROUND OF THE INVENTION

As shown in FIG. 1, a door is provided with a lock 1 which has a lock core for connecting a doorknob 2 so as to control the action of a lock tongue 11. An auxiliary lock 3 has a lock core which is connected with a key insertion seat 4 to facilitate the control of the lock bolt 31 by a key. The lock 1 and the auxiliary lock 3 are independent of each other and must be purchased and mounted at an extra cost. In addition, the doorknob and the key insertion seat 4 undermine the esthetic effect of the door.

As shown in FIG. 2, a linking structure comprises a shell 5 which is provided with an upper lock tongue hole 51, a lower lock tongue hole 52 to facilitate the action of the upper lock tongue 61 and the lower lock tongue 62. A linking mechanism 7 is disposed in the shell 5 for linking the lock tongues 61 and 62. A retaining block 71 is used to join the door knob 81 for driving the upper lock tongue 61. A lock core 72 has one end into which a key is inserted, and other end which is connected with a rotary knob 82. Both ends can actuate the lock tongues 61 and 62 by means of the linking mechanism 7. The lock tool has a considerably large volume. The door body must be provided with two through holes for use in connecting the lock core and the retaining block with the door knob or key. The door knob and the key insertion seat undermine the external appearance of the door body.

SUMMARY OF THE INVENTION

The primary objective of the present invention is to provide a door lock device capable of driving coaxially the lock bolt and the lock tongue. The device comprises a main body, a lock bolt, a lock tongue, a spindle and a moving collar. The main body is provided with a lock bolt, a lock tongue, and a spindle which is provided at both ends with a retaining portion. A lock bolt transmission mechanism connects the lock bolt. The retaining portion is connected with a lock control mechanism. The spindle is provided at both ends with a moving collar having a retaining portion which is externally connected with a rotating mechanism. The door lock is capable of driving the lock bolt and the lock tongue by means of the spindle and the moving collar, or the lock control mechanism and the rotating mechanism, thereby resulting in a substantial reduction in volume of the lock tool. In addition, the door lock can be easily installed at low cost.

It is another objective of the present invention to provide the spindle with a dragging portion which is connected with the insertion portion of the lock bolt. The insertion portion of the lock bolt is provided with an insertion slot in which the dragging portion of the spindle is confined, thereby preventing the lock bolt from withdrawing.

DETAILED DESCRIPTION OF THE EMBODIMENTS

Figure 1:
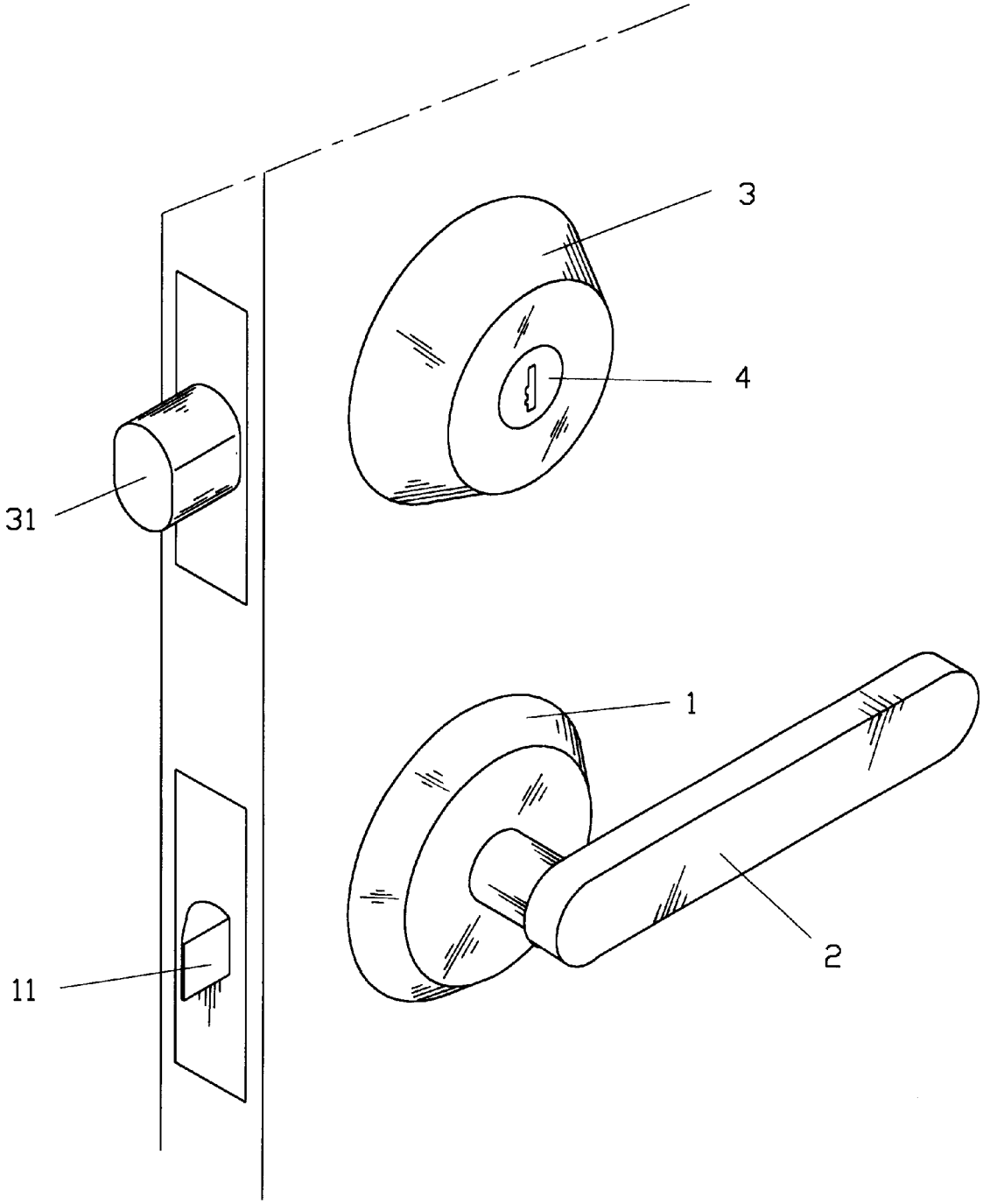
FIG. 1 PRIOR ART
FIG. 1 shows a schematic view of a prior art door body which is provided with two door locks.
Figure 2:
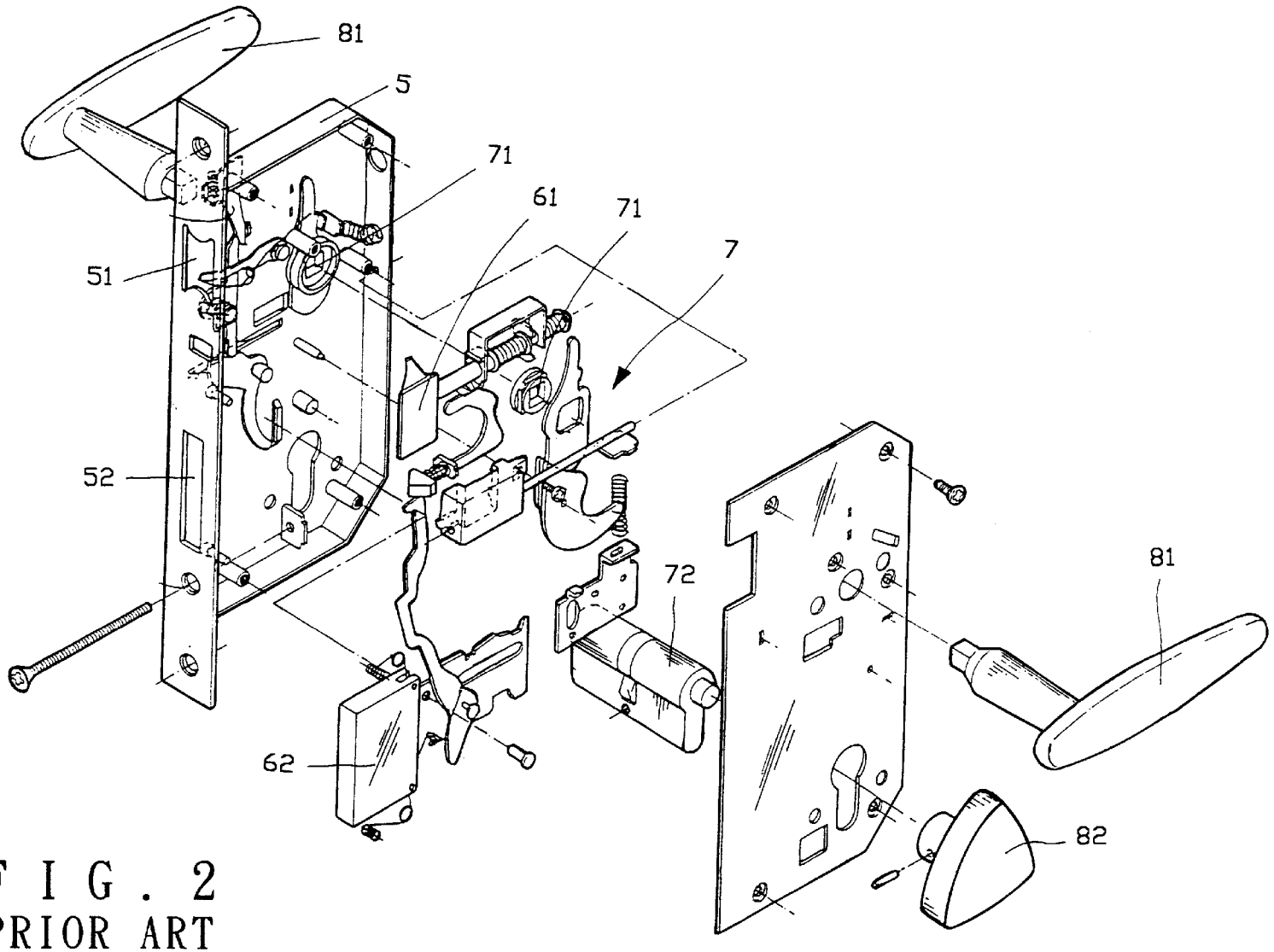
FIG. 2 PRIOR ART
FIG. 2 shows a schematic view of two linking door locks of the prior art.
Figure 3:
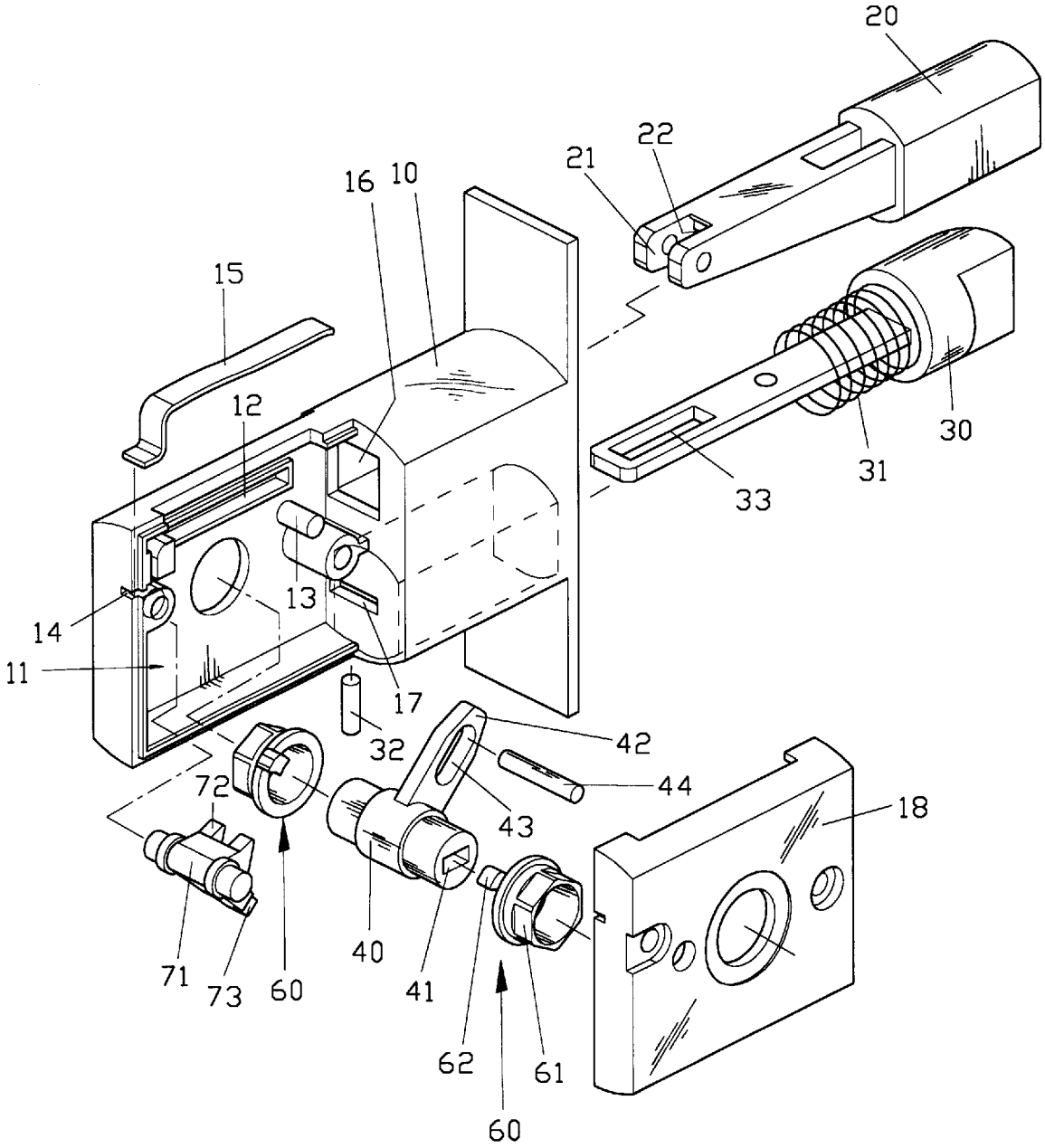
FIG. 3 shows an exploded view of the present invention.
Figure 4:
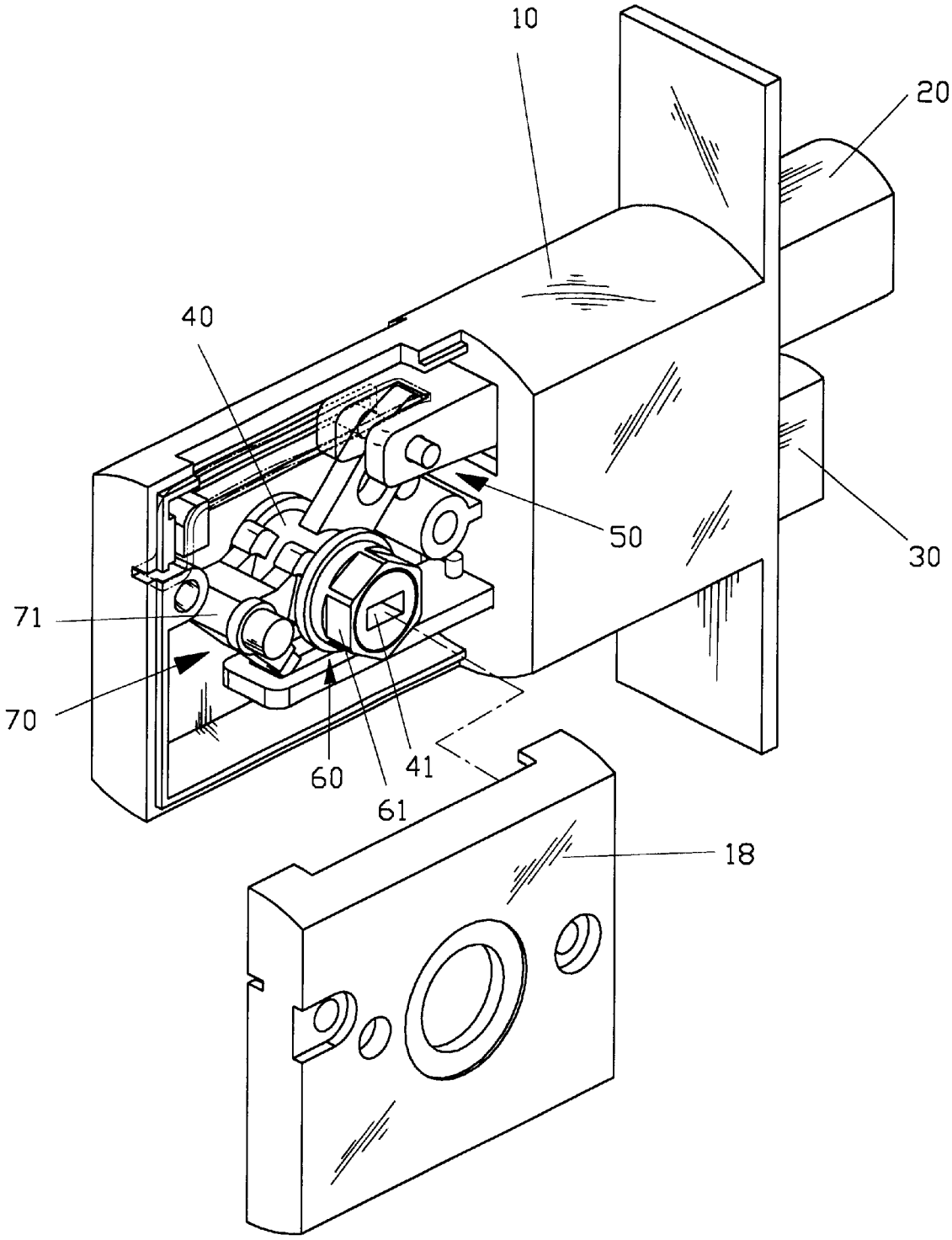
FIG. 4 shows a schematic view of the present invention in conjunction.

As shown in FIGS. 3 and 4, the door lock of the present invention comprises a main body 10, a lock bolt 20, a lock tongue 30, a spindle 40, and a moving collar 60. The main body 10 is provided with a receiving space 11 which has a hole and is provided with a guide slot 12 and a position confining pillar 13. The guild slot 12 is provided with an insertion slot 14 and an elastic piece 15 which is inserted at one end thereof into the insertion slot 14. The main body 10 is further provided with two through holes 16 and 17. The receiving space 11 is provided with an outer cover 18. The lock bolt 20 is put at one end thereof through the through hole 16 of the main body 10. The lock tongue 30 is provided with a spring 31 and is put at one end thereof through the through hole 17 such that a position confining pin 32 is being urged into one end of the through hole 17. The spindle 40 is provided at both ends with a retaining portion 41. The lock bolt transmission mechanism 50 comprises a dragging portion 42 which is disposed on the spindle 40 and is provided with a long slot 43. The mechanism 50 is disposed in the insertion portion 21 of the insertion slot 22 of the lock bolt 20 in conjunction with a pivot 44. The moving collars 60 are disposed at both ends of the spindle 40 and are provided with a polygonal retaining portion 61. The retaining portion 61 of the moving collar 60 and the retaining portion 41 of the spindle 40 are extended out of the receiving space 11 of the main body 10. The moving collar 60 is connected with the lock tongue 30 by a lock tongue transmission mechanism 70. The moving collar 60 is provided with a moving block 62. The receiving space 11 of the main body 10 is provided with a transmission shaft 71 which has two protrusions 72 capable of being moved by the moving block 62 of the moving collars 60, and a dragging portion 73 which is inserted into the long slot 33 of the lock tongue 30.

Figure 5:
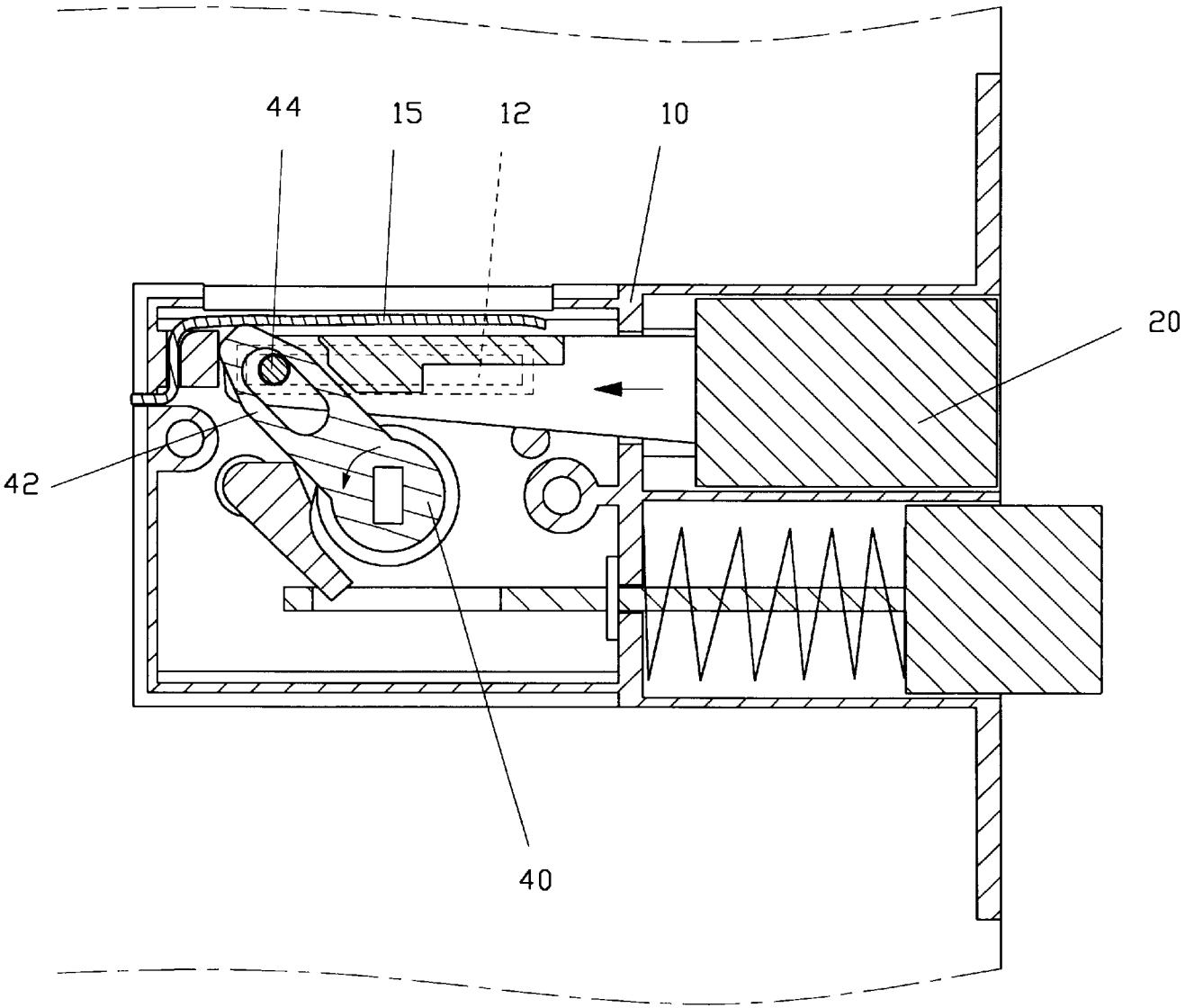
FIG. 5 shows a schematic view of the lock bolt of the present invention in action.
Figure 6:
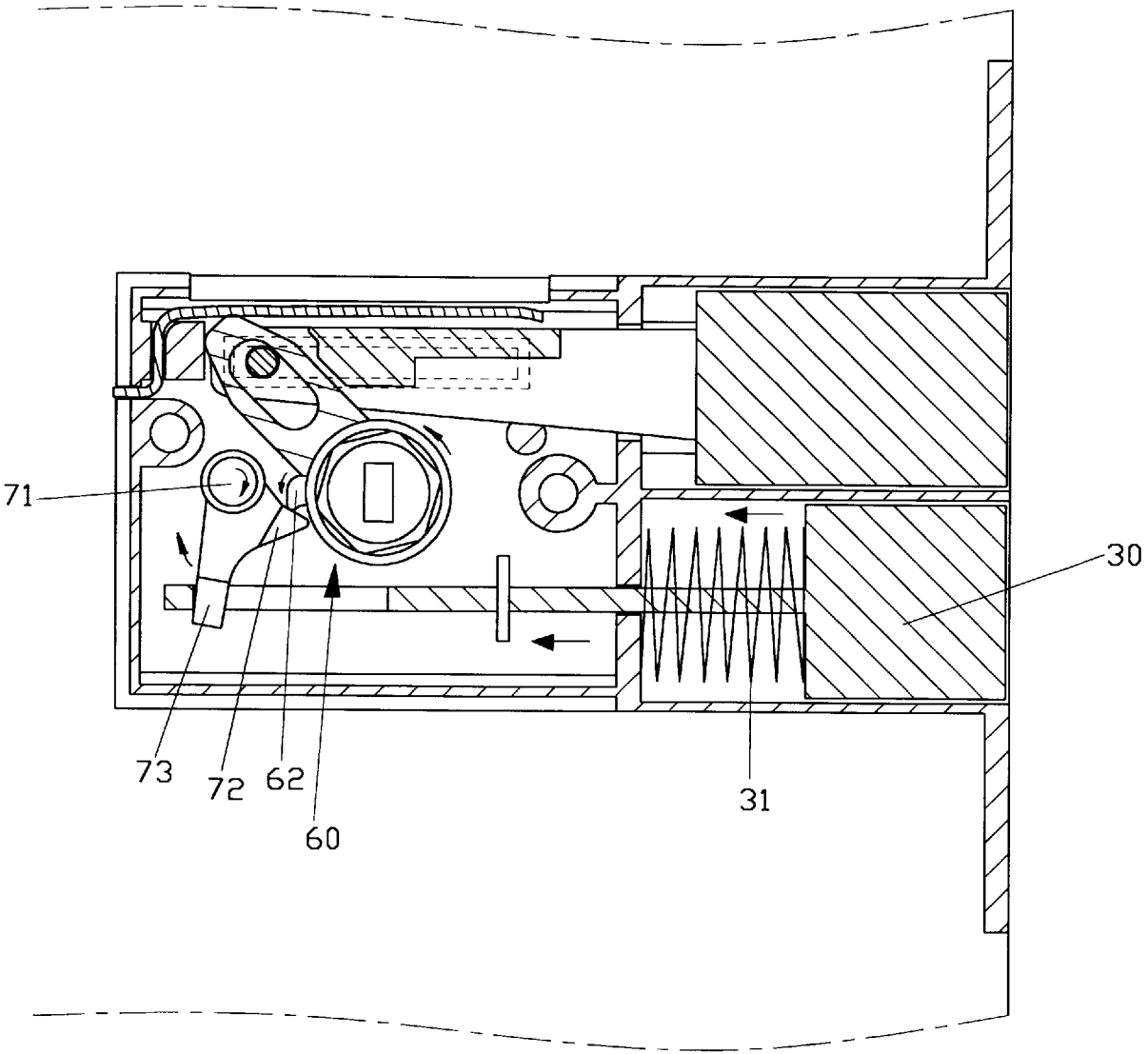
FIG. 6 shows a schematic view of the lock tongue of the present invention in action.
Figure 7:
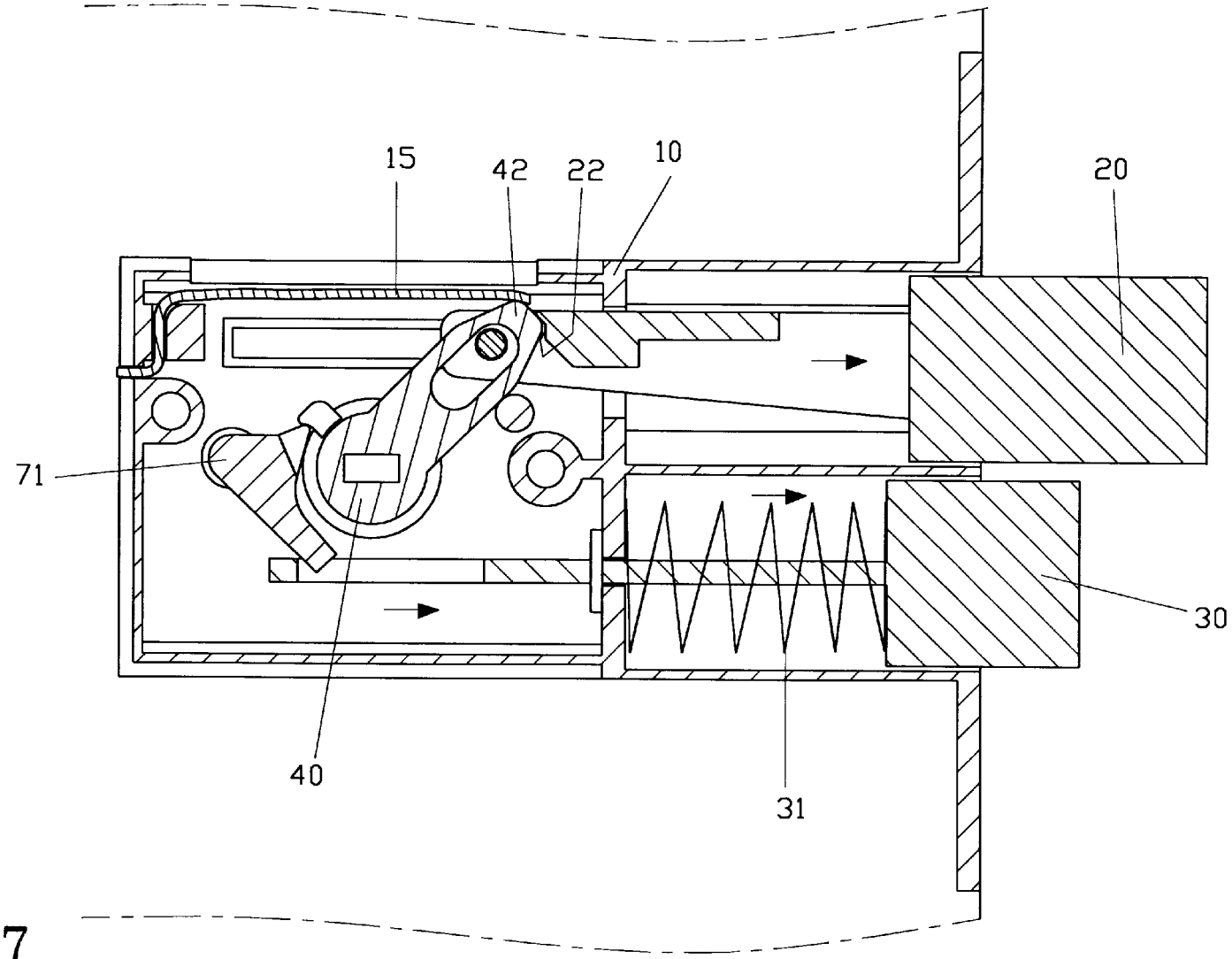
FIG. 7 shows a schematic view of the lock bolt and the lock tongue of the present invention in action.

As shown in FIG. 5, when the spindle 40 is turned, the dragging portion 42 actuates the lock bolt 20 to move inward in conjunction with the pivot 44 whose one end displaces in the guide slot 12 of the main body 10. In the meantime, when the dragging portion 42 swivels, it pushes the elastic piece 15 of the main body 10 upward, thereby resulting in the door lock being in an unlocked state. As shown in FIG. 6, when the lock tongue 30 is opened, the moving collar 60 is rotated such that the moving block 62 causes the protrusions 72 of the transmission shaft 71 to move. As a result, the transmission shaft 71 is driven to turn such that the dragging portion 73 of the transmission shaft 71 actuates the lock tongue 30 to move inward to compress the compression spring 31. The door body can be thus opened. Now referring to FIG. 6 and 7, in the process of closing the lock bolt 20 and the lock tongue 30, the moving collar 60 is first relieved of an external force that keeps the moving collar in a fixed position, thus allowing the lock tongue 30 to be forced by the recovery spring force of the spring 31 to extend outward. In the meantime, the transmission shaft 71 and the moving collar 60 are actuated to return to the original position thereof. The door body is located by the lock tongue 30. The spindle 40 is then turned in reverse to cause the dragging portion 42 to actuate the lock bolt 20 to extend outward. In the meantime, the arcuate corner of the dragging portion 42 is confined in the insertion slot 22 of the lock bolt 20.

Figure 8:
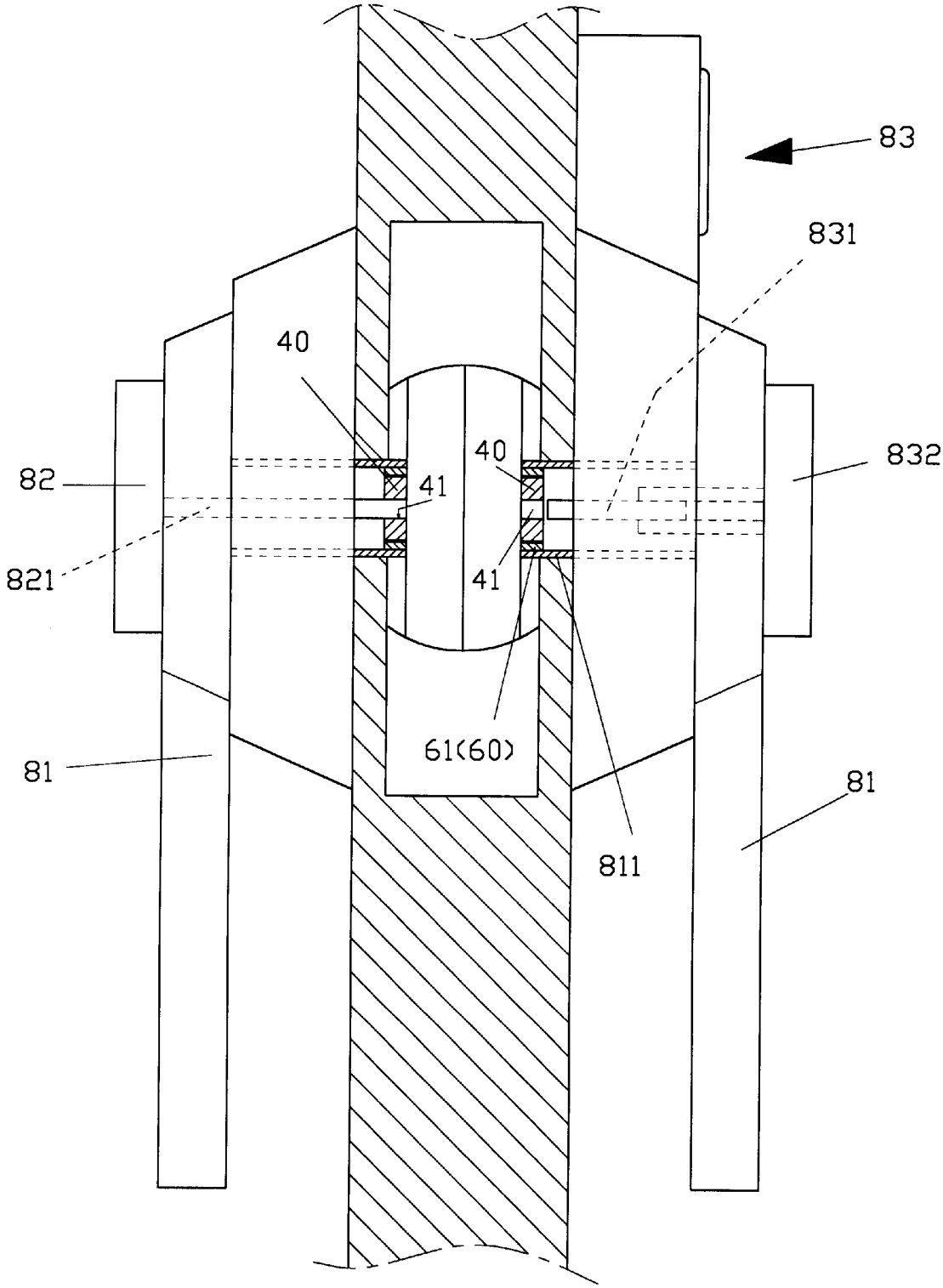
FIG. 8 shows a schematic view of an electrically controlled door lock of the present invention.

As illustrated in FIGS. 6 and 8, the electrically operated door lock of the present invention is provided in the internal side and the external side of the door body with a doorknob 81 serving as a first rotating mechanism. The doorknob 81 has a fitting portion 811, which is disposed on the outer side of the retaining portion 61 of the moving collar 60, so as to actuate the lock tongue 30. The door body is provided in the inner side thereof with a second rotating mechanism coaxial with the first rotating mechanism. The second rotating mechanism is a rotary button 82, which is connected with the spindle 40 such that the retaining block 821 of the rotary button 82 is retained in the retaining portion 41 of the spindle 40. As a result, the door body can be opened from the inside of the door body. The door body is provided in the external side thereof with a lock control mechanism 83 coaxial with the rotating mechanism. The lock control mechanism 83 has a retaining block 831 which can be so controlled as to engage or disengage the retaining portion 41 of the spindle 40. The lock control mechanism 83 is activated by a sensor or remote controller located in the outside of the door body. As soon as the lock control mechanism 83 is activated by a code, the retaining block 831 of the lock control mechanism 83 is inserted into the retaining portion 41 of the spindle 40, thereby enabling the door body to be opened by a rotary button 832 which is located at other end of the retaining block 831.

Figure 9:
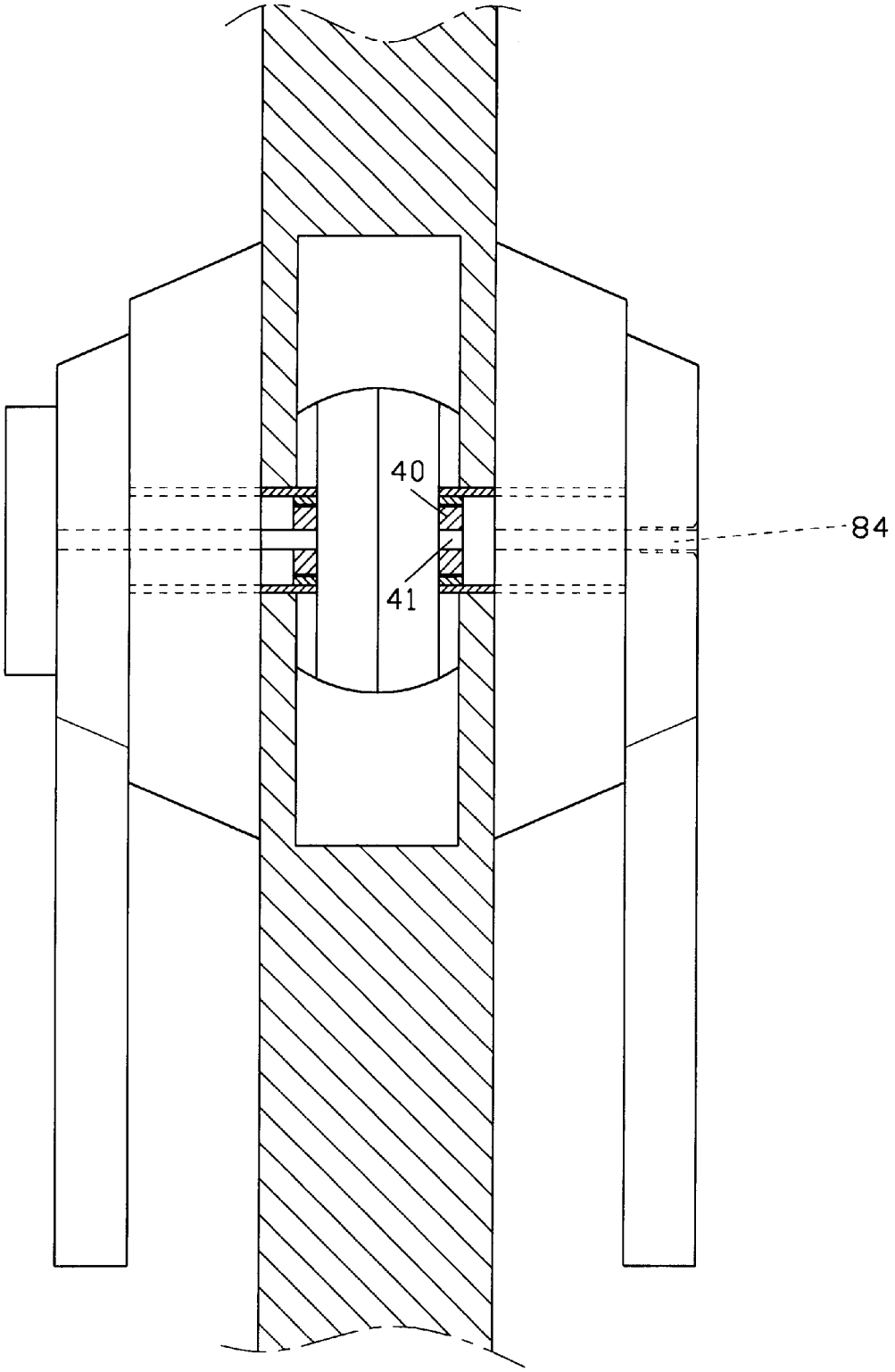
FIG. 9 shows a schematic view of a mechanical door lock of the present invention.

As illustrated in FIG. 9, the present invention is mechanically operated such that the door body is provided in the external side thereof with a key control mechanism which is coaxial with the rotating mechanism and is provided with a keyhole seat 84. In operation, a key is inserted into the keyhole seat 84 such that the key is engaged with the retaining portion 41 of the spindle 40.

The embodiments of the present invention described above are to be regarded in all respects as being merely illustrative and not restrictive. Accordingly, the present invention is thereof to be limited only by the scopes of the following appended claims.

What is claimed is:

1. A door lock device comprising:

a main body provided with a receiving space, an outer cover, and two through holes;

a lock bolt disposed in one of said two through holes of said main body;

a lock tongue disposed in other one of said two through holes of said main body;

a spindle disposed in said receiving space of said main body such that said spindle is connected with a lock bolt transmission mechanism, said spindle being provided at each end thereof with a first retaining portion and being connected with a lock control mechanism located on the outside of said main body; and two moving collars fitted over both ends of said spindle and connected with said lock tongue by a lock tongue transmission mechanism, each of said moving collars being provided with a second retaining portion and connected with a rotating mechanism located on the outside of said main body;

wherein said lock bolt transmission mechanism comprises a dragging portion which is located on said spindle and is provided with a slot, said mechanism further comprising an insertion portion which is located on said lock bolt and is provided with an insertion slot whereby said dragging portion is retained in said insertion slot of said insertion portion in conjunction with a pivot.

2. A door lock device comprising:

a main body provided with a receiving space, an outer cover, and two through holes;

a lock bolt disposed in one of said two through holes of said main body;

a lock tongue disposed in other one of said two through holes of said main body;

a spindle disposed in said receiving space of said main body such that said spindle is connected with a lock bolt transmission mechanism, said spindle being provided at each end thereof with a first retaining portion and being connected with a lock control mechanism located on the outside of said main body; and two moving collars fitted over both ends of said spindle and connected with said lock tongue by a lock tongue transmission mechanism, each of said moving collars being provided with a second retaining portion and connected with a rotating mechanism located on the outside of said main body;

wherein said lock tongue transmission mechanism comprises a moving block which is located on said moving collar, and a transmission shaft which is disposed in said receiving space of said main body and is provided with two protrusions and a dragging portion, said two protrusions being actuated by said moving block so as to cause said transmission shaft to turn, said dragging portion of said transmission shaft being retained in a slot of said lock tongue.

3. The door lock device as defined in claim 1, wherein said receiving space of said main body is provided with a guide slot, a position confining pillar, an insertion slot, and an elastic piece disposed in said insertion slot; wherein said lock tongue is provided with a spring fitted thereover in conjunction with a position confining pin being urged into said through hole of said main body.

4. The door lock device as defined in claim 1, wherein said rotating mechanism is a door knob, said door knob being provided with a fitting portion which is fitted with said retaining portion of said moving collar.

5. The door lock device as defined in claim 1, wherein said lock control mechanism on the inside of the door body is a rotary button having a first retaining block, said first retaining block being retained in one of said first retaining portions of said spindle, the door body further being provided on the external side thereof with a lock control mechanism which is an electrically-controlled mechanism for controlling a second retaining block to be retained by another of said retaining portions of said spindle, said electrically-controlled mechanism having a rotary button to drive said second retaining block.

6. The door lock device as defined in claim 5, wherein said lock control mechanism of the external side of the door body is a key control mechanism which is provided with a keyhole seat for a key to insert thereinto to engage said retaining portion of said spindle.

* * * * *